United States Patent [19]

Adams et al.

[11] Patent Number: 4,981,112

[45] Date of Patent: Jan. 1, 1991

[54] POTABLE HOT WATER STORAGE VESSEL AND METHOD OF MANUFACTURE

[75] Inventors: Charles L. Adams; Weldon M. Hiddleston, both of Fort Worth, Tex.

[73] Assignee: PVI Industries, Inc., Fort Worth, Tex.

[21] Appl. No.: 446,642

[22] Filed: Dec. 6, 1989

[51] Int. Cl.[5] ..... F22B 5/02

[52] U.S. Cl. ..... 122/19; 29/890.03; 126/360 R; 122/149; 220/403; 220/410; 220/465

[58] Field of Search ..... 122/13 R, 19, 136 R, 122/149, 150; 220/410, 403, 465; 29/890.03; 126/360 R

[56] References Cited

U.S. PATENT DOCUMENTS 3,207,358 9/1965 Fliss .
3,275,798 9/1966 Martin ..... 122/13 R
3,365,786 1/1968 Takemura et al. .
4,619,374 10/1986 Yavorsky .
4,635,814 1/1987 Jones ..... 220/403
4,685,589 8/1987 Benton .
4,838,208 6/1989 Stubbe et al. ..... 122/19 X

OTHER PUBLICATIONS

PVI Industries, Inc., *Glashield Turbopower.*

*Primary Examiner*—Edward G. Favors
*Attorney, Agent, or Firm*—Charles D. Gunter, Jr.

[57] ABSTRACT

A potable, hot water storage vessel is shown with a metallic body having a water inlet, water outlet and at least one additional opening communicating the vessel interior and exterior. A flexible, non-molded liner is installed within the vessel interior through the additional opening. The liner has integrally formed ports which extend through the vessel inlet and outlets to the exterior of the vessel body. A bolt-on flange is received on the vessel exterior at the inlet and outlet to form a seal with each of the liner ports.

10 Claims, 3 Drawing Sheets

POTABLE HOT WATER STORAGE VESSEL AND METHOD OF MANUFACTURE

BACKGROUND OF THE INVENTION

1. Cross-Reference To Related Applications.

This application is related to the co-pending application of Charles L. Adams, Ser. No. 07/386,455, filed July 27, 1989, U.S. Pat. No. 4,968,069, entitled "Bolt-On Flange", and assigned to the assignee of the present invention.

2. Field of the Invention.

The present invention relates to water storage vessels of the type used for potable water supplies and, particularly, to such vessels designed for use as water heaters and to methods of making the same.

3. Description of the Prior Art.

A variety of water heater and hot water storage vessel designs are known which typically feature a metallic vessel body, often formed of steel, having a water inlet, a water outlet and at least one additional opening. The additional opening can receive, for example, a heat generating means. In order to provide potable water fit for human consumption, it is necessary to line the vessel body with a material which resists the corrosive attack of water, including the corrosive attack of water containing such common corrosion agents as carbon dioxide, oxygen, chloride ions, sulfate ions, and the like. In the past, the lining was typically applied by spraying on a plastic type material or molding in a corrosion resistant material, as by using a slush type molding process. U.S. Pat. No. 3,207,358, issued Sept. 21, 1965, to Fliss, shows a method of corrosion protecting a water heater in which an inner layer formed of an epoxy resin is covered with an outer layer of a thermoplastic chlorinated polyether resin. The manufacturing process includes multiple spray and curing steps. The commonly called "glass lined" water heaters available commercially have interior surfaces which are coated with a porcelain enamel type material. The assignee of the present invention has, for a number of years, provided water heaters having interiors covered with an electroless nickel which forms a non-ferrous corrosion resistant protective shield within the vessel body.

While the prior designs accomplish their intended purpose of providing corrosion protection, they are time consuming and expensive from a manufacturing standpoint. Also, because the lining was sprayed or molded and therefore integrally bonded to the vessel interior, it was not possible to easily repair or replace a damaged or worn liner.

The present invention has as its object to provide a hot water storage vessel with an improved liner arrangement which resists the corrosive attack of water containing common corrosion agents to thereby ensure a supply of potable water fit for human consumption.

Another object of the invention is to provide a hot water storage vessel having a metallic body and a flexible, non-molded liner which covers substantially the entire interior of the vessel body, the liner being easily installed with a minimum of effort and expense.

Another object of the invention is to provide such a vessel having a replaceable liner which facilitates repair operations so that it is not necessary to discard the vessel body in the case of a damaged or defective liner.

Additional objects, features and advantages will be apparent in the written description which follows.

SUMMARY OF THE INVENTION

The potable, hot water storage vessel of the invention includes a vessel body having a water inlet, a water outlet and at least one additional opening which communicates the vessel interior and exterior. A flexible, non-molded liner is installed within the vessel body through the additional opening. The liner has an integrally formed water inlet and water outlet ports which extend through the vessel water inlet and water outlets, respectively, to the exterior of the vessel body.

A bolt-on flange is also provided to matingly engage the inlet and outlet ports on the exterior of the vessel body in order to receive a variety of accessory fittings.

DETAILED DESCRIPTION OF THE INVENTION

Figure 1:
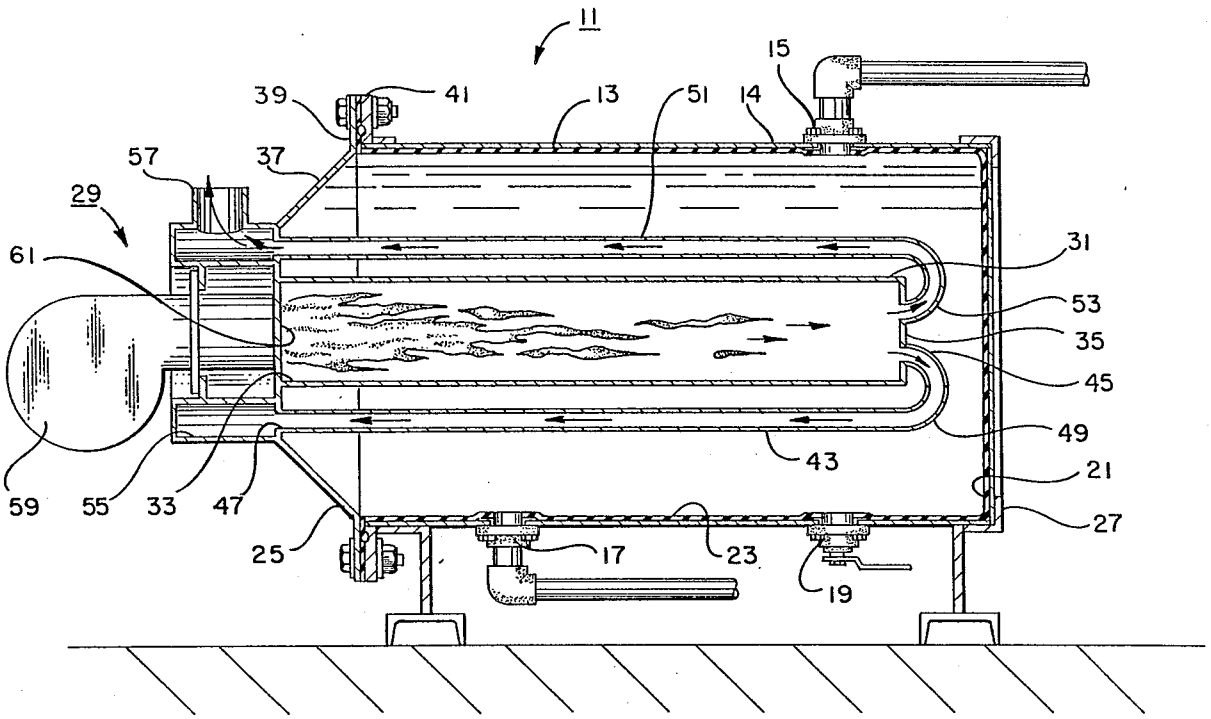
FIG. 1 is a simplified, side view, partially in cross-section, showing an assembled potable, hot water storage vessel of the invention having the replaceable liner installed within the vessel body.

FIG. 1 shows a potable, hot water storage vessel of the invention designated generally as 11. The vessel 11 includes a body 13 having tubular sidewalls 14, the sidewalls 14 being provided with a plurality of fittings. For instance, the fittings can include a cold water inlet 15 a hot water outlet 17 and a pressure relief fitting 19.

The body 13 can be provided in a variety of configurations. For instance, the body 13 can be formed of a suitable metal, such as steel, having an open interior 21 tubular sidewalls 23 and a pair of opposing ends 25, 27. In the embodiment shown, end 25 is initially open and comprises one additional opening in the body 13 besides the cold water inlet 15 and hot water outlet 17. In other embodiments of the invention, the opposing ends 25, 27 are closed and the additional opening is provided in the tubular sidewalls 23. In the embodiment shown in FIG. 2, the steel body 13 can be covered with heavy density fiberglass insulation which is, in turn, covered by segmented steel jacket panels 18 to prevent heat loss.

The additional opening, in this case open end 25, of the vessel 13 is adapted to receive a heat generating means. The heat generating means can be, for instance, gas, oil, or gas/oil fired or, in some embodiments, can comprise an electric resistive heating element. In the embodiment shown in FIG. 1, the heat generating means is a forced draft heating module 29. The module 29 includes a submersible portion 31 which is adapted to be received within the open end 25 and which includes a cylindrical elongated member having an open end 33 and an opposite closed end 35. The combustion chamber assembly 31 also includes a mounting portion 37 for detachably engaging the vessel opening 25 for mounting the module 29 within the vessel. The mounting portion 37 includes a ring like extent 39 which mounts flush against a flange portion 41 of the vessel 13. The flange 41 is securely affixed to the vessel body 13 or is provided as an integral part of the vessel body.

The combustion chamber assembly 31 also includes a plurality of curved fire tubes 43 each of which has an end 45 which communicates with the combustion chamber 31 through closed end 35 and which has an opposite end 47 which extends through the mounting portion 37. Each of the curved tubes 43 is characterized in that at least a portion of the length thereof is generally U-shaped. The combustion chamber portion 31 extends at least partially the length of the curved fire tubes 43 creating a long leg 51 running along the exterior of the combustion chamber and separated by the U-shaped portions 49 from a short leg 53 which joins and extends through the closed end 35.

The ends 47 of the curved tubes communicate with a cylindrically shaped flue collector 55 for conducting the products of combustion from the combustion chamber portion 31 and the curved fire tubes 43 out a flue outlet 57. The flue outlet 57 can be connected to a flue pipe for carrying away waste gas.

A suitable heat source, such as the forced draft burner 59, is mounted in a central opening provided in the flue collector 55 and the mounting portion 37 of the assembly. The forced draft burner 59, as shown in FIG. 1, has a nozzle 61 which communicates with the interior of the combustion chamber portion 31, whereby heat from the burner 59 passes through the interior of the submerged combustion chamber 31, through the fire tubes 43, and into the annular chamber of the flue collector 55 before passing to the flue outlet 57.

The forced draft heating module 29 is described in detail in U.S. Pat. No. 4,465,024, assigned to the assignee of the present invention. Any additional disclosure from the '024 patent not expressly set forth above is incorporated herein by reference. The module is commercially available from PVI Industries, Inc., Fort Worth, Tex. as the TURBOPOWER module. However, as will be apparent to those skilled in the art, other heaters, including electric heaters are within the scope of this invention.

As will further be understood by those skilled in the art, the present invention has application to potable, hot water storage vessels and water heaters having vessel bodies of the vertical tube type which utilizes fire tubes located above a combustion chamber.

Figure 2:
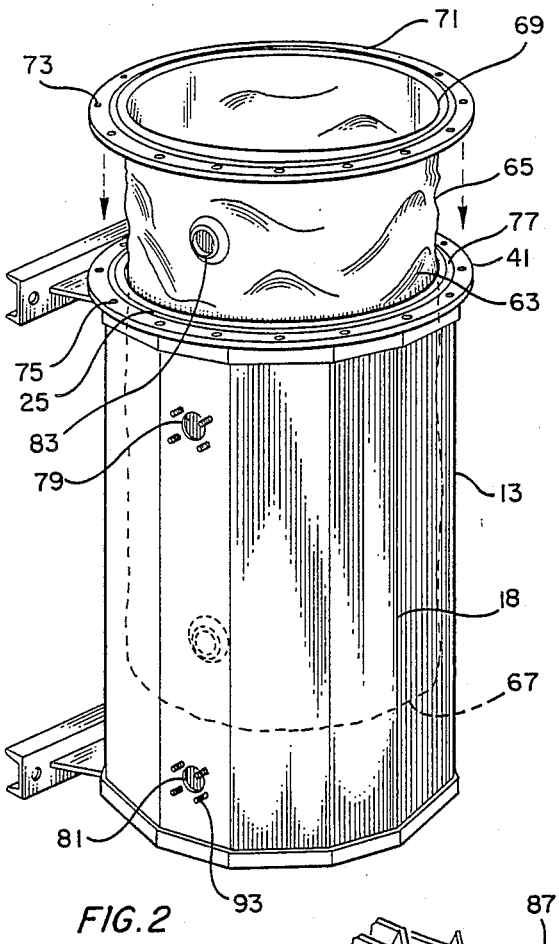
FIG. 2 is a perspective view of the vessel body of FIG. 1 showing the installation of the replaceable liner.

As best seen in FIG. 2, a flexible, non-molded liner 63 is installed within the vessel body 13 through the initially open end 25. The liner 63 has tubular sidewalls 65, a closed end 67 at one extent and an oppositely arranged open end 69 at the opposite extent. In the embodiment shown, the open end 69 is adapted to receive the heat generating means, in this case forced draft heating module 29.

The liner 63 is fabricated from a homogeneous, polymeric material and is preferably either extruded or calendered in thin sheet form prior to installation within the vessel body 13. As will be explained, the sheet material is formed into an envelope or "bag" shape having a closed end 67 by joining one or more seams or weld lines.

The material selected for the liner 63 can conveniently comprise any of a number of non-molded, flexible, polymeric materials. For instance, natural and synthetic elastomers, polyolefines, vinyl plastics EPDM, PVC, and the like. The candidate material must meet the requisite criteria of being joinable to form an envelope or "bag" shape, have the necessary heat resistance for the intended application (typically above about 190° F.), and meet FDA approval for potable water storage. In the embodiment shown, the liner 63 is a polyvinyl chloride having a softening point above about 200° F. Polyvinyl chloride sheet material of the type under consideration will be familiar to those skilled in the art and is used, for instance, as above ground swimming pool liners, as liners for water beds, and the like.

As shown in FIG. 2, the liner open end 69 is preferably provided with a peripheral lip portion 71 which has a plurality of bolt openings 73 adapted to mate with the bolt openings 75 contained in the flange portion 41 of the vessel end 25. The lip portion 71 is formed of a polymeric material which is compatible with the material of the remainder of the liner and which can be fused or vulcanized to the liner 63. In the embodiment shown, the lip portion is injection molded PVC.

Depending upon the materials selected, a variety of techniques are known in the art for joining the lip portion 71 to the liner 63 and for sealing the liner seams. For instance, in the case of EPDM the lip portion and seams are overlapped, the vessel open end is closed, and the vessel interior is pressurized with steam at about 325°-350° F. to vulcanize the lip and seams to the liner. Other methods for joining the selected polymeric materials will be apparent to those skilled in the art including fusing, vulcanizing and the application of adhesive.

The flange portion 41 of the vessel 13 can also be provided with an O-ring groove 77 for receiving an O-ring to provide improved sealing with the mounting portion 37 of the heat generating means 29.

The flexible liner 63 is provided with a plurality of ports in the tubular sidewalls thereof to accommodate, for instance, the water inlet 79 and opening for the pressure relief fitting 81 shown in FIG. 2. As shown in greater detail in FIGS. 3 and 4, each port 83 provided in the liner 63 is formed of a polymeric material, such as a natural or synthetic elastomer which can be, for instance, injection molded and which can be joined to the remainder of the liner, as by welding, fusing or vulcanizing. In the embodiment shown, the ports 83 are dielectrically welded to the liner 63. Each port includes an outwardly extending collar 85 and an integral O-ring portion 87 which extends through the opening provided in the vessel body 13 to the exterior thereof.

Figure 3:
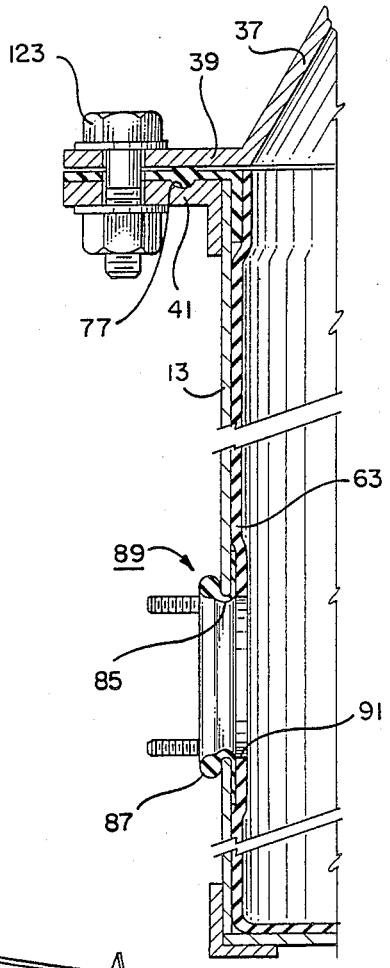
FIG. 3 is an isolated side, cross-sectional view of one of the vessel outlets showing the liner port extending therethrough.

The outwardly extending collar 85 and O-ring portion 87 comprise a gasket member 89 for the flexible liner 63 to facilitate the attachment of a selected fitting onto the vessel exterior. The O-ring portion is of a greater diameter than the port opening 91 provided in the liner and the vessel opening so that the O-ring portion overlays the vessel opening when the liner is installed (FIG. 3).

Figure 4:
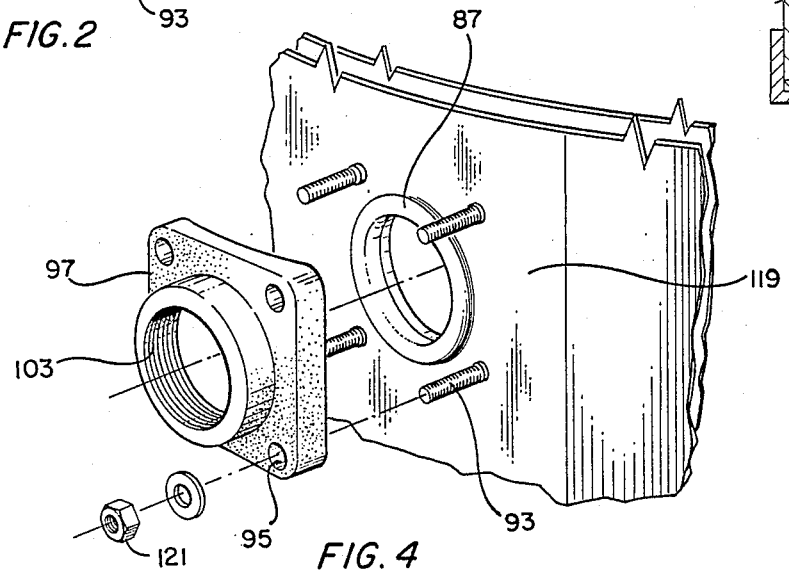
FIG. 4 is a view of a portion of the vessel exterior showing the installation of the bolt-on flange.
Figure 5:
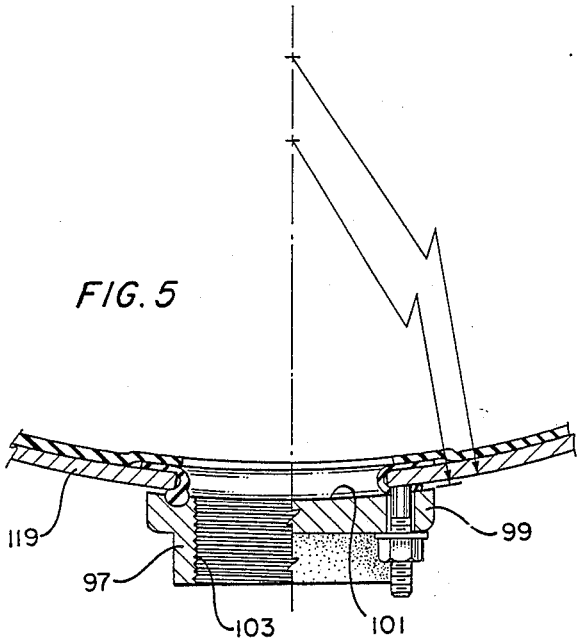
FIG. 5 is a cross-sectional view of the vessel outlet showing the bolt-on flange installed thereon.
Figure 7:
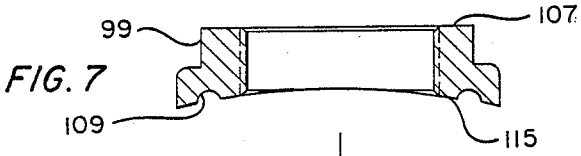
FIG. 7 is a cross-sectional view taken along lines VII.—VII. of FIG. 6.
Figure 6:
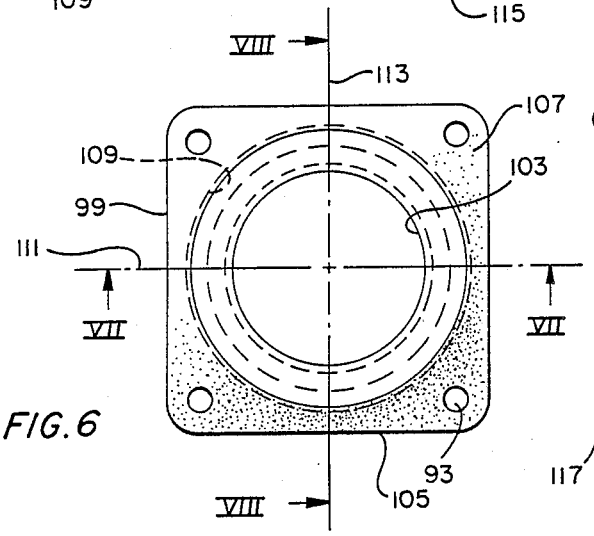
FIG. 6 is a top view of the bolt-on flange of FIG. 5.
Figure 8:
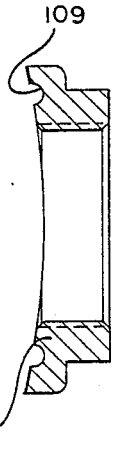
FIG. 8 is a cross-sectional view taken along lines VIII.—VIII. of FIG. 6.

As shown in FIG. 4, the exterior of the vessel body is preferably provided with a plurality of outwardly extending bolts 93 adjacent each of the vessel openings. Preferably, the bolts 93 are stud welded by known resistance welding techniques so that the studs fuse and penetrate into the steel of the vessel sidewall.

Each bolt 93 is adapted to be received within the mating bolt opening 95 provided in a bolt-on flange 97, whereby the integral O-ring portion 87 of each liner collar is sandwiched between the bolt-on flange 97 and the exterior of the vessel body 13 when the flange is installed on the vessel. The flange 97 could be equipped, for example, with a two inch NPT opening used as a pipe coupling, or could be designed to receive other fittings, such as an electric heating element. Any type fitting can be utilized with the flange and liner of the invention.

As shown in FIGS. 5–8, the flange 97 includes a body 99 having an inner surface 101 adapted to be supported at the selected location on the vessel exterior by the bolts 93. A central opening 103, in this case, is a two inch NPT threaded opening for use as a pipe coupling. The body 99 is generally square with the bolt openings 95 being equidistantly spaced about the periphery 105 of the body and communicate the inner and outer surfaces 101, 107. In some embodiments, a retaining means may be provided for maintaining the position of the O-ring portion 87 of the liner collar 85 on the inner surface 101 of the flange. Preferably, the retaining means is an O-ring groove which is located between the bolt openings 93 and the central opening 103 of the flange 97.

The inner surface 101 of the flange body 99 is concave, being curved about both a horizontal and a vertical axis 111, 113 (FIG. 6) respectively, drawn to bisect the body 99. In this way, the inner surface 101 forms a spherical-shaped void (FIG. 7) with the bolt openings 93 forming isolated points of contact with the vessel exterior when the flange is bolted into position. The doubly curved inner surfaces are illustrated as 115, 117 in FIGS. 7 and 8. The radius of curvature employed for each curved inner surface (101 in FIG. 5) is not critical as long as the radius is the same as or smaller than that of the mating surface to which the flange is being attached, in this case, vessel exterior 119. The radius of curvature for the doubly curved surfaces 45, 47 (FIG. 7 and 8) can be identical. As long as the radius of curvature of the inner surface 101 is smaller than the radius of the vessel exterior surface which is to be fit, the flange will rest on four points adjacent the bolt openings 93. In this way, when the nuts 121 are tightened on the threaded shafts of the bolts 93 during the flange installation, the flange will not be bent or stressed.

The O-ring portion 87 of the liner collar 85 must be of a cross-sectional diameter so that a seal is formed when the four corners of the flange touch the vessel exterior. Otherwise, the O-ring dimensions or type of materials is not critical.

The method of lining a potable, hot water storage vessel of the invention will now be briefly described. After welding a plurality of outwardly extending bolts 93 onto the vessel body 13, the liner can be inserted through the vessel open end 25 with the liner being received within the vessel open interior prior to filling the vessel with water. Each collar 85 is inserted through its mating vessel opening, for example opening 79 in FIG. 2, and the lip 71 of the liner is brought to rest upon the flange portion 41 of the vessel body. In some circumstances, it may be desirable to pull a slight vacuum between the liner 63 and the open interior of the vessel during the liner installation. This can be accomplished, for instance, by providing a $\frac{1}{8}''$ pipe tap hole in the vessel body which is later plugged. The heat generating means 29 is then inserted within the vessel interior and within the interior of the liner 63 with the ring like extent 39 of the mounting portion being received over the peripheral lip 71 of the liner. The mounting portion 37 of the heat generating means is then secured to the vessel body 13, as by a plurality of bolts 123 which are passed through the openings in the ring like extent 39, through the openings in the liner peripheral lip 71 and through the mating openings provided in the flange portion 41 of the vessel body.

Although, in the preferred form shown, the liner contacts the interior sidewalls of the vessel body 13, it will be understood that a gap can exist between the liner and the vessel interior. The gap can be void or can be filled with a liquid, a gas, or insulative materials. In any case, the liner must be replaceable and removable from within the vessel interior.

An invention has been provided with several advantages. The flexible liner of the invention replaces more costly and time consuming lining techniques. The liner effectively protects the vessel interior from contamination and corrosion ensuring a supply of potable water fit for human consumption. The liner can be formed from a variety of commercially available materials which are resistant to attack by the common corrosive elements found in water. In order to replace a worn or damaged liner, it is only necessary to remove the mounting portion of the vessel and pull the liner from the vessel interior. The integral port collars provided as a part of the liner assist in positioning the liner within the vessel interior and cooperate with mating bolt-on flanges to provide effective seals for a variety of vessel fittings. Because the flange can be bolted-on, it is not distorted by heat associated with prior art welding techniques. The positioning bolts can be stud welded in a matter of seconds to the vessel exterior and the bolt-on flange can thereafter be installed much more quickly than with the welding steps involved in welding the prior art flange to the vessel exterior. Because of the curvature of the inner surface of the flange body, the flange sits on its four peripheral corners forming a compression seal with the integral O-ring portion of the liner collar and the vessel exterior. There is no tendency to bend or flatten the flange as would happen if the inner surface were flat. The flange can be economically produced from a variety of materials and by a variety of techniques. For instance, the flange can be stamped or cast from steel, bronze, cast iron and the like.

While the invention has been shown in only one of its forms, it is not thus limited but is susceptible to various changes and modifications without departing from the spirit thereof.

I claim:

1. A potable, hot water storage vessel, comprising:

a metallic body having an interior, an exterior, tubular sidewalls and a pair of opposing ends, the metallic body having a water inlet, a water outlet and at least one additional opening for receiving a heat generating means;

a flexible, non-molded liner removably installed within the metallic body through the additional opening prior to filling the vessel with water, the liner having water inlet and water outlet ports which extend through the vessel water inlet and water outlets, respectively, to the exterior of the metallic body, the liner inlet and outlet ports being formed of flexible, polymeric materials which are joined to the liner prior to inserting the liner within the vessel interior;

a heat generating means installed within the additional opening; and means for closing the additional opening once the liner and heat generating means are installed.

2. The potable, hot water storage vessel of claim 1, wherein the liner has tubular sidewalls, a closed end at one extent and an oppositely arranged open end at the opposite extent, the open end being adapted to receive the heat generating means.

3. The potable, hot water storage vessel of claim 2, wherein the water inlet and water outlet ports include an outwardly extending collar and an integral O-ring portion which extends through the water inlet and water outlet of the metallic body to the exterior thereof.

4. The potable, hot water storage vessel of claim 3, wherein the exterior of the metallic body is provided with a plurality of outwardly extending bolts adjacent each of the water inlet and water outlet, the outwardly extending bolts being adapted to engage a plurality of mating bolt openings provided in a bolt-on flange, whereby the integral O-ring portion of each liner port is sandwiched between the bolt-on flange and the exterior of the metallic body when the flange is installed on the exterior of the vessel.

5. The potable, hot water storage vessel of claim 4, wherein the bolt-on flange includes a body having an inner surface adapted to be supported at a selected location on the vessel exterior and an outer surface, the mating bolt openings provided in the flange body being spaced about the periphery of the flange body and communicating the inner and outer surfaces thereof, the spacing of the bolt openings being selected to mate with the outwardly extending bolts provided on the vessel exterior, and wherein the inner surface of the bolt-on flange is concave, being curved about both a horizontal and a vertical axis drawn to bisect the flange body, thereby forming a spherical-shaped void on the inner surface, the bolt openings forming isolated points of contact with the vessel exterior when the flange is bolted into position.

6. The potable, hot water storage vessel of claim 5, wherein the flange body has a central opening for receiving an associated fitting, the central opening being located within the periphery of the bolt receiving openings.

7. The potable, hot water storage vessel of claim 6, wherein the inner surface of the flange body includes an O-ring groove located between the central opening and the bolt receiving openings.

8. A method of lining a potable, hot water storage vessel of the type which includes a vessel body for dispensing potable water through a water outlet, the water being supplied through a water inlet, the vessel body having an interior, and exterior and opposing ends and also being provided with at least one additional opening, the method comprising the steps of:

welding a plurality of outwardly extending bolts onto the vessel exterior about the periphery of the water inlet and the water outlet;

removably installing a flexible, non-molded liner within the vessel interior through the additional opening prior to filling the vessel with water, the liner having integrally formed water inlet and water outlet ports;

inserting the liner water inlet and outlet ports through the vessel water inlet and water outlets, respectively, to the exterior of the vessel body;

providing a bolt-on flange with a body having an inner surface and an outer surface, the inner surface being provided with a plurality of bolt openings spaced about the periphery of said body and communicating said inner and outer surfaces;

locating a bolt-on flange on the vessel exterior at each of the water inlet and water outlet by passing the outwardly extending bolts through the bolt openings provided in the flange bodies;

sealing the flanges to the vessel exterior by bolting the flanges onto the vessel with the respective liner ports sandwiched between the vessel exterior and the bolt-on flanges; and closing the additional opening.

9. The method of claim 8, wherein each flange body is provided with an inner surface which is formed doubly concave, being curved about both a horizontal and a vertical axis drawn to bisect the flange body, thereby forming a spherical-shaped void on the flange inner surface, the bolt openings forming isolated points of contact with the vessel exterior when said flange is bolted into position.

10. The method of claim 9, wherein an O-ring groove is provided on the inner surface of each flange body for maintaining the position of said O-ring on the inner surface.

* * * * *